United States Patent [19]

Iguchi et al.

[11] Patent Number: 4,831,978

[45] Date of Patent: May 23, 1989

[54] INTERNAL COMBUSTION ENGINE HAVING REINFORCED STRUCTURE

[75] Inventors: Isamu Iguchi; Hirofumi Ohshima; Hiroaki Deguchi, all of Hiroshima; Tsuyoshi Tsuchida, Iwakuni, all of Japan

[73] Assignee: Mazda Motor Corporation, Hiroshima, Japan

[21] Appl. No.: 94,415

[22] Filed: Sep. 9, 1987

[30] Foreign Application Priority Data

Sep. 10, 1986 [JP] Japan ..... 61-213069

[51] Int. Cl.[4] ..... F02F 7/00

[52] U.S. Cl. ..... 123/195 H; 384/429

[58] Field of Search ..... 123/198 E, 195 C, 195 S, 123/195 H, 195 R; 384/429; 184/6.5; 74/606 R

[56] References Cited

U.S. PATENT DOCUMENTS

| | | | |
|---|---|---|---|
| 1,759,147 | 5/1930 | Vincent | 123/195 H |
| 3,841,203 | 10/1974 | Bruce | 92/73 |
| 3,942,502 | 3/1976 | Gorres et al. | 123/195 R |
| 4,287,861 | 9/1981 | Lettner et al. | 123/195 C |
| 4,458,640 | 7/1984 | Shimada | 123/194 H |
| 4,467,754 | 8/1984 | Hayashi et al. | 123/195 H |
| 4,497,292 | 2/1985 | Hayashi et al. | 123/195 H |

FOREIGN PATENT DOCUMENTS

| | | |
|---|---|---|
| 3444838 | 6/1986 | Fed. Rep. of Germany . |
| 55-40360 | 3/1980 | Japan . |
| 60-27803 | 2/1985 | Japan . |

*Primary Examiner*—David A. Okonsky

*Attorney, Agent, or Firm*—Fleit, Jacobson, Cohn & Price

[57] ABSTRACT

An internal combustion engine comprises reinforcing means secured to an edge portion of a lower opening of the cylinder block at a peripheral edge portion thereof. The reinforcing member has a plate-like shape, has connecting parts extending laterally with respect to the direction of the engine for connecting the facing edge portions of the lower opening of the cylinder block and is formed with openings for passage of oil at the front portion thereof and is secured to an oil pan at the lower surface of its front portion. The rear portion of said reinforcing means forms a part of an outer lower wall of a crank case containing a crank shaft and bifurcates into an upper branch extending backwardly and upwardly and a lower branch extending backwardly and downwardly. The upper branch has an end portion for connection with the cylinder block and the lower branch has an end portion for connection with a transmission case.

8 Claims, 3 Drawing Sheets

INTERNAL COMBUSTION ENGINE HAVING REINFORCED STRUCTURE

BACKGROUND OF THE INVENTION

The present invention relates to an internal combustion engine having a reinforced structure, and more particularly to such an engine with a compact structure able to reduce vibration and decrease the amount of noise transmitted to a cabin of a vehicle.

DESCRIPTION OF PRIOR ART

In an internal combustion engine, since the cylinder block has a shape like a bell, the edge portion of the lower opening of the cylinder block is easily vibrated by noise generated within the cylinder block. The noise generated by the vibration is amplified by the oil pan and is transmitted through the air or the vehicle body to the cabin.

Japanese Utility Model Application No. 40360/1980 proposes an internal combustion engine structure for reducing the noise transmitted to the cabin by preventing the edge portion of the lower opening of the cylinder block from vibrating. In the proposed structure, a reinforcing member is provided to connect the lower end of the cylinder block and the oil pan over the entire area of the lower end of the cylinder block and the edge portions of the lower opening of the cylinder block facing each other in the lateral direction of the engine are connected with each other by connecting members of the reinforcing member.

According to the above described prior art engine, although the vibration of the edge portion of the lower opening of the cylinder block can be effectively prevented, it becomes extremely difficult to connect the cylinder block and a transmission case with sufficient strength. More specifically, a transmission case is generally secured to an end portion in the longitudinal direction of the cylinder block. With the prior art structure, however, it is extremely difficult to ensure an area sufficient for connecting the transmission case and the cylinder block and to connect the transmission and the cylinder block with sufficient strength. As a result, the angle between the cylinder block and the transmission case changes easily under the force acting on them, which mainly generated by the engine operation. Consequently, the vertical vibration of the power plant constituted by the engine and the transmission, due to a bending force acting on them cannot be prevented and such vibration of the power plant is inevitably transmitted to the vehicle cabin.

To solve the above described problems, Japanese Utility Model Application No. 27803/1985 discloses a cylinder block in which a bearing beam is formed integrally with bearing caps and in which a plurality of arms extending laterally and downwardly are formed at the rear end thereof to be connected with the transmission case, whereby the area for connecting the cylinder block and the transmission is increased and the connecting strength between the engine and the transmission case is improved.

However, this prior art engine cannot prevent the above described vibration of the edge portion of the lower opening of the cylinder block. Further, since the arms are connected with the transmission case at portions spaced in the vertical direction on substantially the same vertical plane, when the pitching force produced due to unevenness of the road acts on the power plant, the phase of the force component acting on the upper connecting portion and that acting on the lower connecting portion are opposite to each other and, therefore, the connecting strength of the connecting portions becomes lower with the passage of time.

Furthermore, U.S. Pat. No. 3,942,502 proposes to secure the rear end of an oil pan made as a casting to the transmission case in order to rigidly connect them. According to this structure, it is possible to reduce the vertical vibration of the power plant (hereinafter referred to as "power plant bending") due to the bending force acting on it but the total weight of the engine is increased.

SUMMARY OF THE INVENTION

It is therefore the object of the present invention to provide an internal combustion engine having a compact reinforced structure capable both of reducing vibration of an edge portion of a lower opening of a cylinder block and of reducing power plant bending, without increasing the weight of the engine.

According to the present invention, the above and other objects can be accomplished by an internal combustion engine having a reinforced structure comprising reinforcing means secured to an edge portion of a lower opening of the cylinder block at a peripheral edge portion thereof and having at least one connecting means extending laterally with respect to the direction of the engine for connecting the facing edge portions of the lower opening of the cylinder block, said reinforcing means having a plate-like shape and being formed with at least one opening for passage oil at a front portion thereof and being secured to an oil pan on a lower surface of said front portion of said reinforcing means, a rear portion of said reinforcing means forming a part of an outer bottom wall of crank case means containing a crank shaft and bifurcating into upper branch means extending backwardly and upwardly and lower branch means extending backwardly and downwardly, said upper branch means having an end portion to be connected with said cylinder block and said lower branch means having a end portion to be connected with a transmission case.

The above and other objects and features of the present invention will become apparent from the following description made with reference to the accompanying drawings.

DESCRIPTION OF THE PREFERRED EMBODIMENTS

Figure 1:
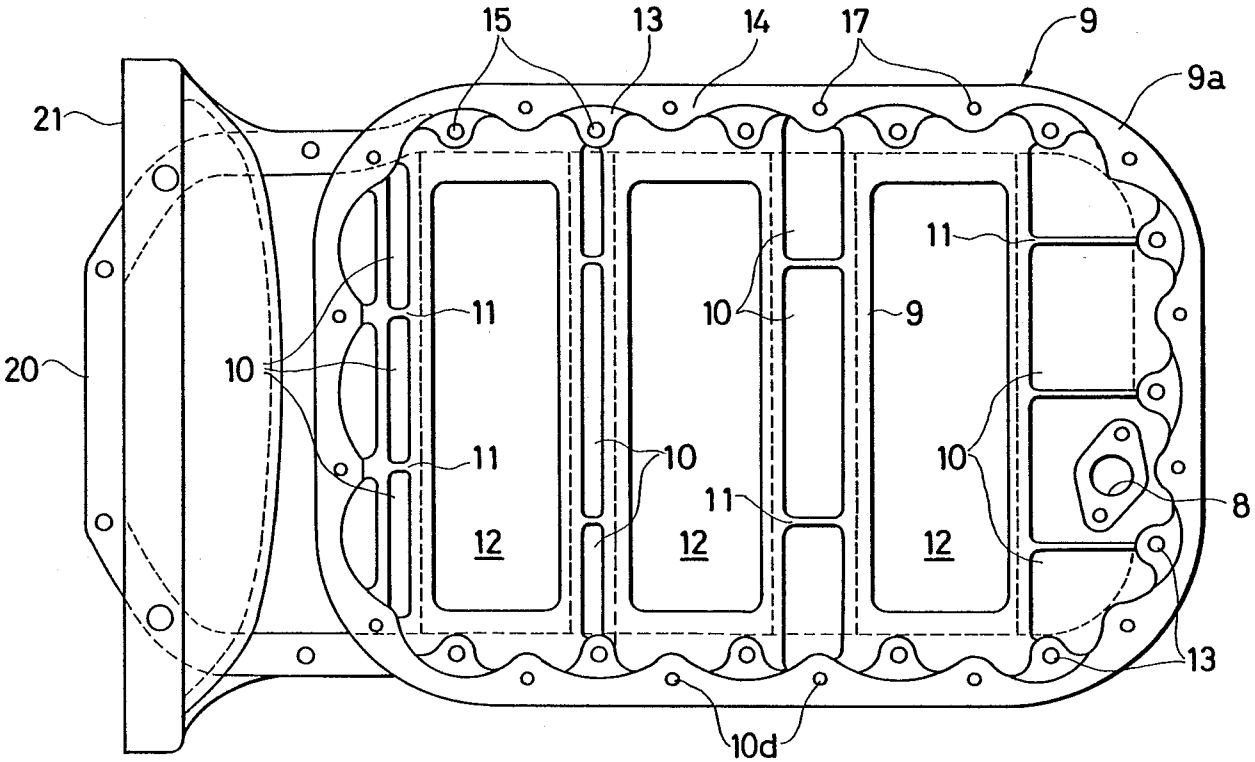
FIG. 1 is a schematic drawing showing a bottom plan view, with oil pan removed, of an internal combustion engine having a reinforced structure which is an embodiment of the present invention.
Figure 2:
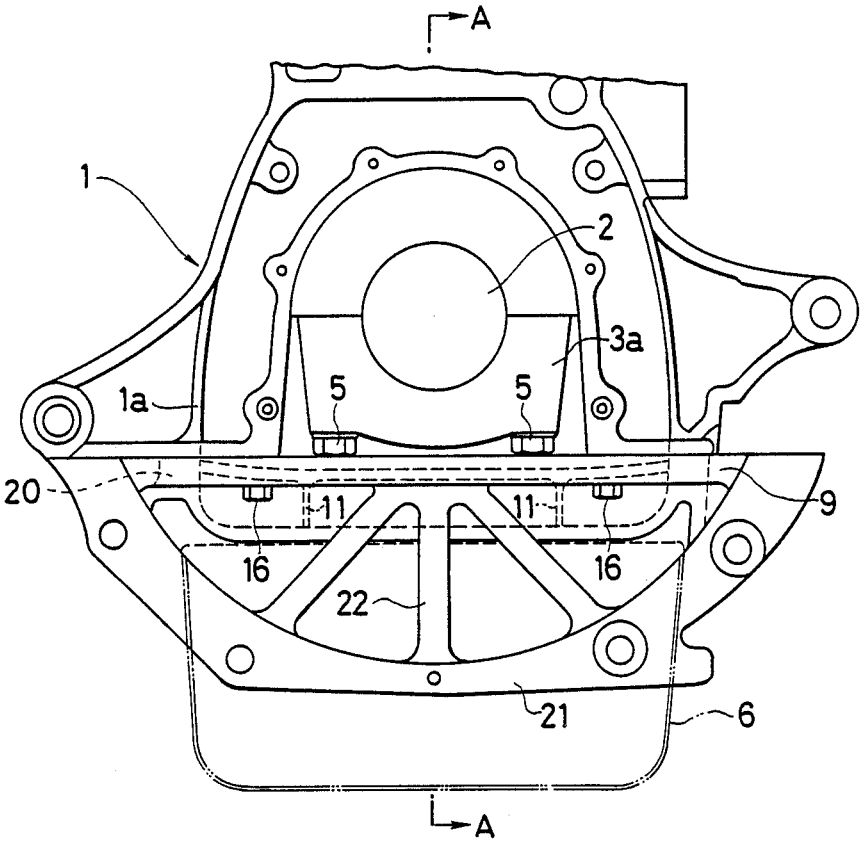
FIG. 2 is a schematic drawing showing a rear plan view of an internal combustion engine having a reinforced structure which is an embodiment of the present invention.
Figure 3:
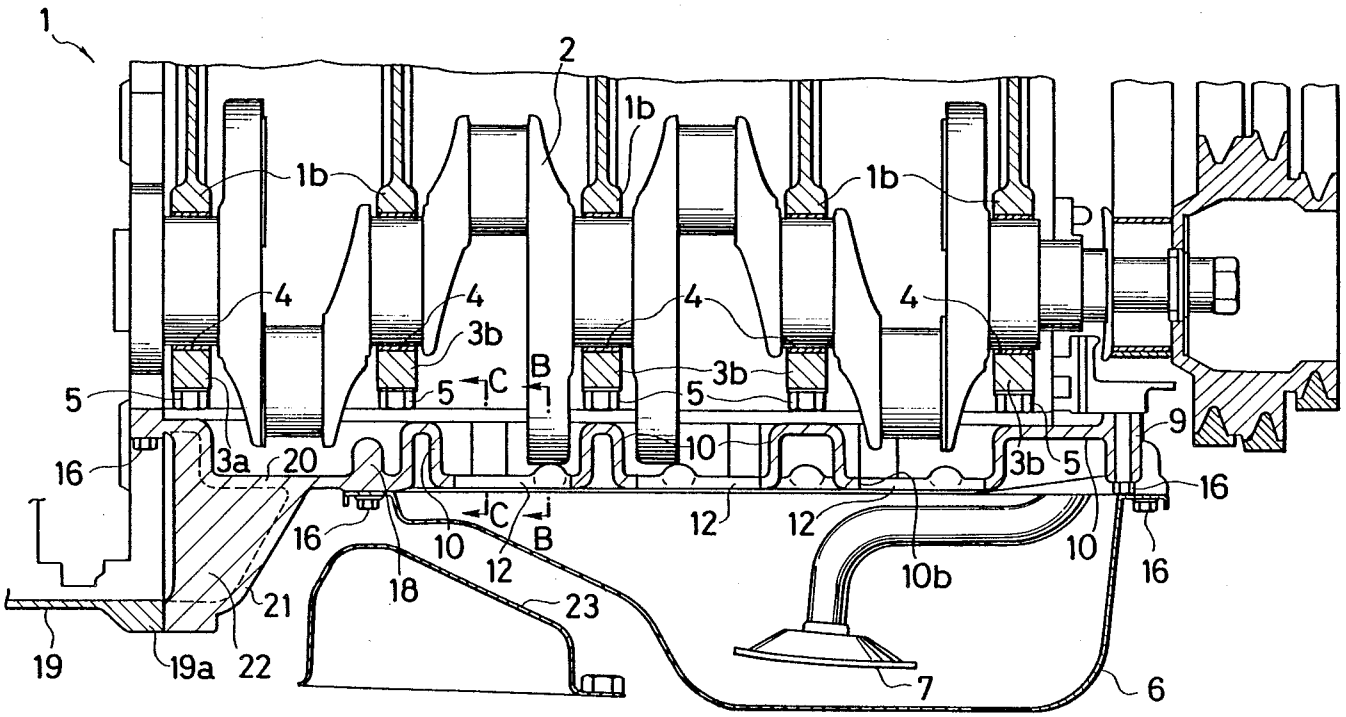
FIG. 3 is a schematic drawing showing a cross sectional view taken on line A—A of FIG. 2.

FIGS. 1 to 3 show an internal combustion engine having a reinforced structure which is an embodiment of the present invention. A cylinder block 1 is formed like a bell and a crank shaft 2 is provided at a lower portion of thereof. The crank shaft 2 is supported at bearing portions 1*b* of the cylinder block 1 by fastening with bolts 5 both ends of a primary bearing cap 3*a* and bearing caps 3*b* which are fitted around the crank shaft 2 via bearing metals 4 so that the crank shaft 2 can be supported to be rotatable. An oil pan 6 is provided below the cylinder block 1 and oil collecting in the oil pan 6 is fed to movable parts such as the crank shaft 2 through a strainer 7 and an oil passage 8 by an oil pump (not shown).

A reinforcing member 9 having a plate-like shape is secured at a peripheral edge portion 9*a* thereof to a skirt portion 1*a* which forms an edge portion of a lower opening of the cylinder block 1. The reinforcing member 9 has a plurality of connecting members 10 extending laterally with respect to the direction of the engine to connect facing skirt portions 1*a*. Each of the connecting members 10 is provided at a position below one of the bearing caps 3*b* between adjacent cylinder bores and consists of a plurality of ribs projecting upwardly at positions corresponding to those of the bearing caps 3*b* and extending laterally with respect to the direction of the engine. The height of the connecting members 10 is determined so that the connecting members 10 do not contact with the bolts 5. Further, ribs 11 extending longitudinally with respect to the direction of the engine are provided on each of the connecting members 10. The oil pan 6 is disposed below the reinforcing member 9 so as to be located below the lower surface of the front and middle portion of the reinforcing member 9 and is secured to a lower surface of the reinforcing member 9. The reinforcing member 9 is provided at a portion thereof above the oil pan with a plurality of openings 12 for passage of oil, that is, at the front and middle portion thereof. Oil fed to the movable portions through the strainer 7 and the oil passage 8 falls through openings 12 to be collected in the oil pan 6 for recirculation.

Figure 4:
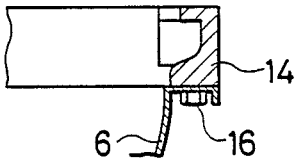
FIG. 4 is a schematic drawing showing a cross sectional view taken on line B—B of FIG. 3.
Figure 5:
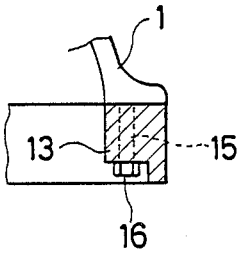
FIG. 5 is a schematic drawing showing a cross sectional view taken on line C—C of FIG. 3.

At the peripheral edge portion 9*a* of the reinforcing member 9, there are provided a flange 13 extending inwardly and a flange 14 extending inwardly below the flange 13. As shown in FIGS. 4 and 5, the flange 13 has holes 15 for securing the skirt portion 1*a* thereto by bolts 16 and the flange 14 has holes 17 for securing the oil pan 6 thereto by bolts 16. The holes 15 and 17 are arranged alternately to make it easy to secure the cylinder block 1 and the oil pan 6 to the reinforcing member 9 and the holes 17 for securing the oil pan 6 being positioned closer to the outer surface of the peripheral edge portion 9*a* of the reinforcing member 9 than the holes 15 for securing the skirt portion 1*a*. According to this arrangement, a compact reinforcing member 9 can be obtained. The flanges 13 and 14 are connected by a peripheral wall of the reinforcing member 9 at a peripheral portion of the reinforcing member 9. The rear portion of the oil pan 6 is secured to the flange 14 of the reinforcing member 9 at a position just below the bearing cap 3*b* separating adjacent cylinder bores and there is provided on the reinforcing member 9 in the vicinity of the rear portion of the oil pan 6 a rib 18 extending laterally and connecting the right and left peripheral walls of the reinforcing member 9 and having substantially the same height as that of the peripheral wall.

A transmission case 19 containing a transmission is provided at the rear side portion of the reinforcing member 9. At the rear side of the portion thereof secured to the oil pan 6, the reinforcing member 9 bifurcates into a plate-shaped upper branch member 20 and a plate-shaped lower branch member 21. The upper branch member 20 extends upwardly and is connected with the cylinder block 1 by bolts 16 at a rear end portion thereof which is formed to horizontally extend in substantially the lateral direction of the engine and which has holes for bolts 16 extending in the vertical direction. The lower branch member 21 extends downwardly and is connected with a bell mouth portion 19*a* of the transmission case 19 by bolts 16 at a rear end portion thereof which is formed to vertically extend in substantially the lateral direction of the engine and which has holes for bolts 16 extending in the longitudinal direction of the engine. The upper branch member 20 is connected with the cylinder block 1 to the rear of the position where the lower branch member 21 is connected with the bell mouth portion 19*a* of the transmission case 19. Further, there are provided three ribs 22 extending radially from the upper branch member 20 to the lower branch member 21 to connect them.

Furthermore, a rear portion of the reinforcing member 9 forms a part of an outer lower wall of a crank case containing the crank shaft 2 therein and a frame member 23 of the vehicle body is arranged below the rear portion of the reinforcing member 9, while the oil pan 6 is disposed below the front and middle portion of the reinforcing member 9.

According to the above described embodiment, since the reinforcing member 9 is connected with the skirt portion 1*a*, that is, the edge portion of the lower opening of the cylinder block 1 and it is connected with the transmission case 19 at the end of the lower branch member 21, it is possible to reduce the vibration of the edge portion of the lower opening of the cylinder block 1, and the transmission case 19 can be connected rigidly to the cylinder block. Further, since the oil pan 6 is arranged below the front and middle portion of the reinforcing member 9 and the reinforcing member 9 itself forms a part of the outer lower wall of the crank case above the frame member 23 of the vehicle body, an engine with a compact structure can be obtained. Moreover, since the rear portion of the reinforcing member 9 forming a part of the outer lower wall of the crank case has no openings 12 for passage of oil, it is possible to considerably improve the rigidity of the power plant. Furthermore, since the reinforcing member 9 is bifurcated into the upper branch member 20 extending upwardly and the lower branch member 21 extending downwardly at the rear side of the portion where the oil pan 6 is secured and the upper branch member 20 is connected with the cylinder block 1 and the lower branch member 21 is connected with the bell mouth portion 19*a* of the transmission case 19, it is possible to connect the reinforcing member 9 with the cylinder block 1 and the transmission case 19 at positions sufficiently apart from each other in the vertical direction. As a result, the rigidity of the power plant can be remarkably increased. In addition to the above described advantages, according to the above described embodiment, since the upper branch member 20 is connected with the cylinder block 1 to the rear of the position where the lower branch member 21 is connected with the transmission case 19, the resistance of the power plant to the pitching force can be considerably improved and it is possible to prevent the rigidity of the power plant from degrading with the passage of time.

As described above with respect to the preferred embodiment, according to the present invention, since the edge portions of the lower opening of the cylinder block facing each other in the lateral direction of the engine are connected by the reinforcing member, it is possible to prevent the edge portion of the lower opening of the cylinder block from vibrating, whereby noise transmitted to the vehicle cabin is minimized. Further, the rear portion of the reinforcing member is bifurcated into the upper branch member extending upwardly and the lower branch member extending downwardly and the upper branch member is connected with the cylinder block and the lower branch member is connected with the transmission case. Therefore, it is possible to connect the reinforcing member with the cylinder block and the transmission case at positions sufficiently apart from each other in the vertical direction and the rigidity of the power plant can be remarkably increased with respect to force applied thereto in the vertical plane. Furthermore, since the oil pan is arranged below the front and middle portion of the reinforcing member and the reinforcing member itself forms a part of the outer lower wall of the crank case, it is possible to obtain an engine with a compact structure. Moreover, since the rear portion of the reinforcing member forming a part of the outer lower wall of the crank case has no openings for passage of oil and the rigidity thereof is high, it is possible to considerably improve the rigidity of the power plant. Nevertheless, since the reinforcing member is provided independently of the oil pan, even if the reinforcing member is made as a casting to increase the rigidity of the power plant, it is possible to minimize the increase in weight of the power plant by making the oil pan of steel plate.

The present invention has thus been shown and described with the reference to the specific embodiments. However, it should be noted that the present invention is in no way limited to the details of the described arrangements but changes and modifications may be made without departing from the scope of the appended claims.

We claim:

1. An internal combustion engine having a reinforced structure in which a cylinder block having lower edge portions is connected with a transmission case at a rear portion thereof, said internal combustion engine comprising reinforcing means secured to an edge portion of a lower opening of the cylinder block at a peripheral edge portion thereof and having at least one connecting means extending laterally with respect to the longitudinal direction of the engine for connecting facing edge portions of the lower opening of the cylinder block, said reinforcing means having a plate-like shape and being formed with at least one opening for passage of oil at a front portion thereof and being secured to an oil pan on a lower surface of said front portion of said reinforcing means, a rear portion of said reinforcing means forming a part of an outer bottom wall of crank case means containing a crank shaft and bifurcating into upper branch means extending backwardly and upwardly and lower branch means extending backwardly and downwardly, said upper branch means having a rear end portion to be connected with said cylinder block and said lower branch means having a rear end portion to be connected with a transmission case, said upper branch means being connected with said cylinder block at a rear end thereof and said lower branch means being connected with said transmission case at a rear end thereof, said rear end of the upper branch means being located to the rear of the rear end of the lower branch means, said reinforcing means being made as a casting and said oil pan being made of steel plate.

2. An internal combustion engine having a reinforced structure in accordance with claim 1 in which each of said rear ends of the upper and lower branch means extends in substantially a lateral plane with respect to the direction of the engine and in which said rear ends are connected by at least one rib.

3. An internal combustion engine having a reinforced structure in accordance with claim 2 in which said ribs comprise a plurality of ribs extending radially from one of the upper and lower branch means to the other.

4. An internal combustion engine having a reinforced structure in accordance with claim 2 in which said rear end of the upper branch means extends in a horizontal plane and has a plurality of holes for bolts extending in the vertical direction and in which said rear end of the lower branch means extends in a vertical plane and has holes for bolts extending longitudinally with respect to the direction of the engine.

5. An internal combustion engine having a reinforced structure in which a cylinder block having lower edge portions is connected with a transmission case at a rear portion thereof, said internal combustion engine comprising reinforcing means secured to an edge portion of a lower opening of the cylinder block at a peripheral edge portion thereof and having at least one connecting means extending laterally with respect to the longitudinal direction of the engine for connecting facing edge portion of the lower opening of the cylinder block, said reinforcing means having a plate-like shape and being formed with at least one opening for passage of oil at a front portion thereof and being secured to an oil pan on a lower surface of said front portion of said reinforcing means, a rear portion of said reinforcing means forming a part of an outer bottom wall of crank case means containing a crank shaft and bifurcating into upper branch means extending backwardly and upwardly and lower branch means extending backwardly and downwardly, said upper branch means having a rear end portion to be connected with said cylinder block and said lower branch means having a rear end portion to be connected with a transmission case, said reinforcing means having at least one rib projecting upwardly and extending in a lateral direction of the engine at a position corresponding to a portion separating adjacent cylinder bores of the cylinder block and at least one rib being associated with each of said ribs that extends in the longitudinal direction of the engine, said reinforcing means being made as a casting and said oil pan being made of steel plate.

6. An internal combustion engine having a reinforced structure in which a cylinder block having lower edge portions is connected with a transmission case at a rear portion thereof, said internal combustion engine comprising reinforcing means secured to an edge portion of a lower opening of the cylinder block at a peripheral edge portion thereof and having at least one connecting means extending laterally with respect to the longitudinal direction of the engine for connecting facing edge portions of the lower opening of the cylinder block, said reinforcing means having a plate-like shape and being formed with at least one opening for passage of oil at a front portion thereof and being secured to an oil pan on a lower surface of said front portion of said reinforcing means, a rear portion of said reinforcing means forming a part of an outer bottom wall of crank case means containing a crank shaft and bifurcating into upper branch means extending backwardly and upwardly and lower branch means extending backwardly and downwardly, said upper branch means having a rear end portion to be connected with said cylinder block and said lower branch means having a rear end portion to be connected with a transmission case, a first flange provided at a peripheral edge portion of the reinforcing means extending inwardly and having holes extending vertically for securing the cylinder block thereto by bolt means, a second flange provided at a peripheral edge portion of the reinforcing means extending inwardly below said first flange and having holes extending vertically for securing the oil pan thereto by bolt means, said holes of the first flange and the holes of the second flange being arranged alternately in the longitudinal direction of the engine, said holes of the second flange being closer to the outer peripheral surface of the peripheral edge portion of the reinforcing member than said holes of the first flange, said reinforcing means being made as a casting and said oil pan being made of steel plate.

7. An internal combustion engine having a reinforced structure in which a cylinder block having lower edge portions is connected with a transmission case at a rear portion thereof, said internal combustion engine comprising reinforcing means secured to an edge portion of a lower opening of the cylinder block at a peripheral edge portion thereof and having at least one connecting means extending laterally with respect to the longitudinal direction of the engine for connecting facing edge portions of the lower opening of the cylinder block, said reinforcing means having a plate-like shape and being formed with at least one opening for passage of oil at a front portion thereof and being secured to an oil pan on a lower surface of said front portion of said reinforcing means, a rear portion of said reinforcing means forming a part of an outer bottom wall of crank case means containing a crank shaft and bifurcating into upper branch means extending backwardly and upwardly and lower branch means extending backwardly and downwardly, said upper branch means having a rear end portion to be connected with said cylinder block and said lower branch means having a rear end portion to be connected with a transmission case, said reinforcing means having a first flange for securing the cylinder block thereto and a second flange provided below the first flange for securing the oil pan thereto and a peripheral wall connecting said first and second flanges and a rib means extending laterally to the longitudinal direction of the engine and arranged in the vicinity of a rear portion of said second flange, the rear piston of said second flange being arranged at a position between adjacent cylinder bores of the cylinder block and said rib means connecting right and left peripheral walls of the reinforcing means and having substantially the same height as that of said peripheral walls, said reinforcing means being made as a casting and said oil pan being made of steel plate.

8. An internal combustion engine having a reinforced structure in which a cylinder block having lower edge portions is connected with a transmission case at a rear portion thereof, said internal combustion engine comprising reinforcing means secured to an edge portion of a lower opening of the cylinder block at a peripheral edge portion thereof and having at least one connecting means extending laterally with respect to the longitudinal direction of the engine for connecting facing edge portions of the lower opening of the cylinder block, said reinforcing means having a plate-like shape and being formed with at least one opening for passage of oil at a front portion thereof and being secured to an oil pan on a lower surface of said front portion of said reinforcing means, a rear portion of said reinforcing means forming a part of an outer bottom wall of crank case means containing a crank shaft and bifurcating into upper branch means extending backwardly and upwardly and lower branch means extending backwardly and downwardly, said upper branch means having a rear end portion to be connected with said cylinder block and said lower branch means having a rear end portion to be connected with a transmission case, said reinforcing means having a first flange for securing the cylinder block thereto and a second flange provided below the first flange for securing the oil pan thereto and a peripheral wall connecting said first and second flanges and a rib means extending laterally to the longitudinal direction of the engine and arranged in the vicinity of a rear portion of said second flange, the rear portion of said second flange being arranged at a position between adjacent cylinder bores of the cylinder block and said rib means connecting right and left peripheral walls of the reinforcing means and having substantially the same height as that of said peripheral walls.

* * * * *